US010413000B1

(12) United States Patent
Reeves

(10) Patent No.: US 10,413,000 B1
(45) Date of Patent: Sep. 17, 2019

(54) JERSEY SHIRT

(71) Applicant: Steven Reeves, Brooklyn Center, MN (US)

(72) Inventor: Steven Reeves, Brooklyn Center, MN (US)

( * ) Notice: Subject to any disclaimer, the term of this patent is extended or adjusted under 35 U.S.C. 154(b) by 0 days.

(21) Appl. No.: 15/697,010

(22) Filed: Sep. 6, 2017

Related U.S. Application Data

(63) Continuation-in-part of application No. 13/773,836, filed on Feb. 22, 2013, now abandoned.

(60) Provisional application No. 61/634,122, filed on Feb. 23, 2012.

(51) Int. Cl.

| | |
|---|---|
| ***A41D 15/00*** | (2006.01) |
| ***A41D 1/04*** | (2006.01) |
| ***A41D 1/06*** | (2006.01) |
| ***A41D 27/08*** | (2006.01) |

(52) U.S. Cl.
CPC ..... *A41D 15/005* (2013.01); *A41D 1/04* (2013.01); *A41D 1/06* (2013.01); *A41D 27/08* (2013.01)

(58) Field of Classification Search
CPC ..... A41D 27/08; A41D 27/04; A41D 27/00; A41D 15/005; A41D 1/04; A41D 1/06; G01F 21/02; G01F 21/026; G09F 21/02; G09F 21/026
See application file for complete search history.

(56) References Cited

U.S. PATENT DOCUMENTS 1,226,654 A * 5/1917 Gordon ..... A41D 1/18 2/106
1,647,656 A * 11/1927 Olsen ..... A41B 1/00 2/115
2,222,090 A * 11/1940 Schaumer ..... A41B 9/06 2/113
2,527,258 A * 10/1950 Kahn ..... A41D 3/00 2/115
2,647,261 A * 8/1953 Rassner ..... A41D 1/04 2/115
D170,681 S * 10/1953 Dougherty ..... D2/845
2,685,690 A * 8/1954 Chrisman ..... G09F 21/02 2/1
4,078,265 A * 3/1978 Condit ..... A41D 1/04 2/115
4,296,498 A * 10/1981 Vinson ..... A41D 15/005 2/115
4,453,274 A * 6/1984 Allen ..... A41D 1/04 2/102
5,086,516 A * 2/1992 Baxter ..... A41D 1/02 2/102
5,201,075 A * 4/1993 Svetich ..... A41D 15/00 2/108
5,694,651 A * 12/1997 Thomas ..... A41D 13/0015 2/115
5,813,051 A * 9/1998 Counter ..... G09F 21/02 2/102

(Continued)

*Primary Examiner* — Danny Worrell
(74) *Attorney, Agent, or Firm* — Eggink & Eggink; Anthony G. Eggink; Katrina M. Eggink

(57) ABSTRACT

A jersey shirt having a frontal appearance of a dress shirt and a back appearance of a sports jersey. The jersey shirt may be a unitary garment or have separable garment components. The jersey shirt provides a formal dress shirt frontal appearance when worn with a jacket and provides a sports jersey appearance on the back of the shirt when the jacket is removed.

20 Claims, 10 Drawing Sheets

(56) References Cited

U.S. PATENT DOCUMENTS 5,953,757 A * 9/1999 Blanks, I ..... A41D 27/08 2/108
6,032,287 A * 3/2000 Kallas ..... A41B 13/10 2/69
6,182,296 B1 * 2/2001 Hosogai ..... A41D 15/005 2/108
6,298,485 B1 * 10/2001 Heller ..... A41D 3/005 2/126
D463,092 S * 9/2002 Perez ..... D2/717
6,550,066 B1 * 4/2003 Brassey ..... A41D 13/0015 2/108
D474,323 S * 5/2003 Carter ..... D2/717
D505,642 S * 5/2005 Puett, III ..... D11/172
D578,736 S * 10/2008 Lim ..... A41B 1/00 D2/841
7,571,495 B2 * 8/2009 Emeth ..... A41D 27/08 2/115
7,707,857 B1 * 5/2010 McMurray ..... D04B 1/104 66/176
D625,080 S * 10/2010 Sanchez, III ..... D2/750
7,836,520 B2 * 11/2010 Marquis ..... A41D 13/1245 2/114
D632,462 S * 2/2011 Hartman ..... D2/831
D632,871 S * 2/2011 Woodall ..... D2/717
D635,332 S * 4/2011 DeRobertis ..... D2/831
D648,925 S * 11/2011 Anderson ..... D2/717
D650,154 S * 12/2011 Saavedra ..... D2/840
D661,467 S * 6/2012 Whitefield ..... D2/840
D668,841 S * 10/2012 McKinley ..... D2/840
8,453,265 B2 * 6/2013 Forte ..... A47G 1/0616 2/115
D688,033 S * 8/2013 McCaughey ..... D2/842
D698,127 S * 1/2014 Cheatham ..... D2/847
8,898,820 B2 * 12/2014 Sokolowski ..... A41D 1/002 2/23
D720,919 S * 1/2015 Swanson ..... D2/840
D724,292 S * 3/2015 Amarasiriwardena ..... D2/847
2003/0188469 A1 * 10/2003 Torres ..... G09F 15/00 40/586
2004/0158911 A1 * 8/2004 Amnuel ..... A41B 9/06 2/115
2004/0163155 A1 * 8/2004 Haughey ..... A41D 1/04 2/69
2006/0048265 A1 * 3/2006 Deadwyler ..... A41B 9/06 2/115

* cited by examiner

JERSEY SHIRT

This application is a Continuation-in-Part of U.S. patent application Ser. No. 13/773,836, filed on Feb. 22, 2013, and which claims the benefit of U.S. Provisional Patent Application Ser. No. 61/634,122, filed on Feb. 23, 2012, and is incorporated by the reference herein.

BACKGROUND OF THE INVENTION

The present invention relates generally to wearing apparel and particularly to a jersey shirt which combines the frontal look of a formal dress shirt and the back look of a sports jersey.

Various combinations of clothing articles have been proposed and worn in the past. For example, reversible garments such as shirts, jackets, hats, etc. are known as well as shirts giving the appearance of a short sleeve shirt worn over a long sleeve shirt, for example. Furthermore, sports team logos have also been provided on reversible clothing articles which permit the wearer to choose either of two team logos to be displayed. However, these prior art clothing articles are generally limited to similarly styled wearing apparel and to being worn in the same environment or setting.

The wearing apparel of the present invention overcomes the limitation of the prior art by providing an article of clothing having different or opposing styles and which may be worn in a formal setting as well as in a sports facility or sports bar, for example. The wearing apparel of the invention provides a versatile garment which provides a formal shirt appearance when worn with a suit coat or jacket and provides a sports jersey appearance when the suit coat or jacket is removed.

SUMMARY OF THE INVENTION

An article of clothing or jersey shirt which combines different styles of wearing apparel. The jersey shirt of the invention combines the frontal look of a formal dress shirt and the back look of a sports jersey.

The formal frontal look of the jersey shirt of the invention permits the wearer to go to the office or other work environment and/or to attend church, a wedding or other formal activity by wearing a suit coat or sports jacket over the jersey shirt to provide the appropriate formal dress attire for a particular formal occasion. For example, the jersey shirt collar, button down front portion and sleeve cuffs provide a formal appearance. Subsequently, the wearer is able to go to a stadium for a sporting event or to attend a football party, for example, by removing the suit coat or jacket and exposing the back of the garment comprising the sports jersey of the wearer's football team, for example. The latter showing team colors, color combinations, a numeral and lettering, for example.

The formal frontal portion of the shirt may include various formal styles including various collars, buttons, pockets, sleeves, cuffs, etc., as shown in the drawings. The sports jersey back portion of the garment may include various sports teams, including professional, college and other sports teams representing football, basketball, hockey, rugby, baseball and other sports teams, for example. The terms "formal" and "sports jersey" are further discussed below with reference to the drawings. For purposes of this invention, the term "formal" has a meaning as to structure as a frontal shirt portion having a button down front, long sleeves terminating in cuffs and having a collar capable of receiving a tie. The term "sports jersey" has a meaning as to structure as a back view shirt portion having multiple colors, a numeral and lettering.

The formal frontal portion of the shirt may include various formal styles including various collars, buttons, pockets, sleeves, cuffs, etc. The sports jersey back portion of the garment may include various sports teams, including professional, college and other sports teams representing football, basketball, hockey, rugby, baseball, soccer, auto and bicycle racing teams and other sports teams and clubs, for example.

The jersey shirt of the invention may comprise a unitary garment, be reversible or be comprised of a separable garment which allows the appearance of a formal frontal shirt portion to be utilized by a plurality of sports-related or other jersey attires on the back of the shirt. The jersey shirt may have configurations, styles and colors suitable for adult men and women as well as children. The jersey shirt may also be provided in a set of similarly coordinated garments, i.e., in different sizes and having different names, suitable for a family unit, for example.

Although the jersey shirt may be a unitary structure and a unitary reversible garment, the format frontal portion of the garment may also be provided with fastening means positioned at predetermined locations to receive a sport jersey garment component, which may be reversible to provide multiple sports jersey appearances on the back of the garment. Seam strips may be provided along with the fastening means so that the reversible shirt sleeve end seams match the seams and fabric of the formal shirt front when the two shirt pieces are fastened together.

It is a benefit of the present invention to provide a shirt that can be worn in both a formal and in a sports environment. It is a further benefit of the present invention to provide a jersey shirt that can be worn by fans, athletes, former or retired athletes and the like.

It is another benefit of the present invention to provide a jersey shirt which is reversible to provide a different or related back portion that may be used to change the shirt's appearance. It is yet another benefit of the present invention to provide fastening means for the fastening of the removable back portion to a front formal shirt frame so that the fastening means have the appearance of traditional shirt seams.

These and other benefits and advantages of this invention will become clear from the following description by reference to the drawings.

DETAILED DESCRIPTION OF THE PREFERRED EMBODIMENTS

Figure 1:
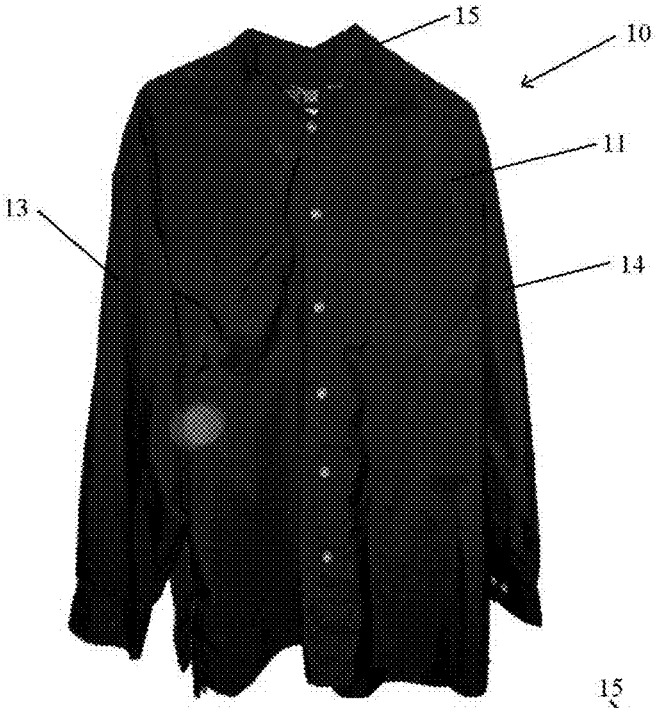
FIG. 1 is a frontal view of the jersey shirt of the present invention and showing the formal shirt appearance.
Figure 2:
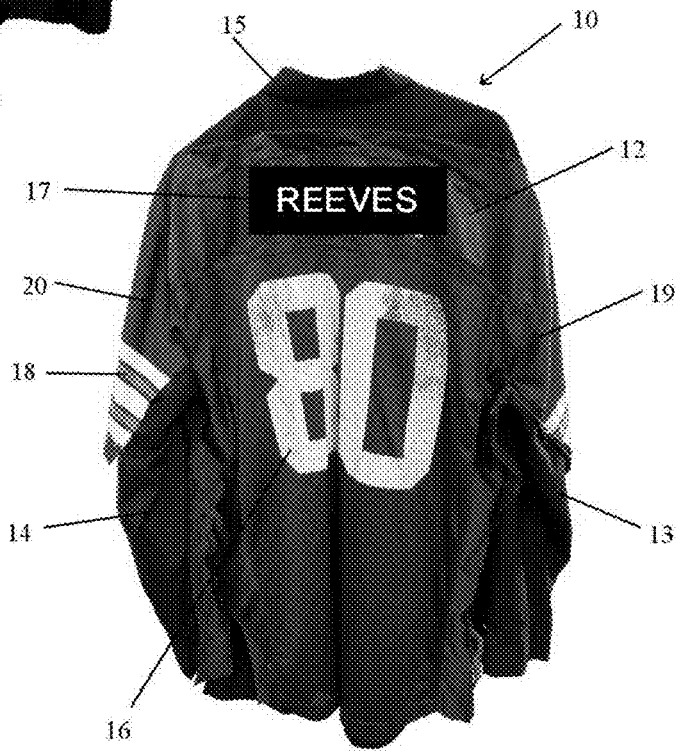
FIG. 2 is a rear view of the jersey shirt of FIG. 1 and showing the sports jersey appearance of the shirt.

Referring to FIGS. 1 and 2, the jersey shirt .0 of the invention is shown having a frontal portion 11 and a back portion 12. The frontal portion 11 is shown constructed of a formal or dress shirt having a body with sleeves 13, 14 and a collar 15. The back portion 12 is shown having the structure and appearance of a sports jersey, i.e., football jersey.

The frontal portion 11 may be structured to have various formal or dress shirt details and appearances. The back portion 12 may be structured to show various sports jersey appearances including professional, college, high school sports teams, etc. as well as clubs and organizations. The sports jersey may include team colors, and distinctive designs, i.e., lettering, numerals, logos, color combinations, stripes, etc., so that the jersey shirt may be worn by sports fans, athletes, and former or retired athletes representing various professional, college, high school, grade school and amateur sports teams and various clubs for example. Lettering 17, numeral 16 and team colors 18 are shown located on back portion 12 of jersey shirt 10 in FIG. 2. The lettering on the back portion of each jersey shirt may contain a name, i.e., a sport player's name or the wearer's name.

The frontal portion 11 described herein as having a formal appearance is shown to have a collar, long sleeves, cuffs and buttons. Other formal shirt appearances are shown in FIGS. 6, 11, 17, 19, 21 and 23. The back portion 12 described herein as having a sports jersey appearance is shown having a numeral, a name and a football jersey design. Other sports jersey appearances are shown in FIGS. 3, 5, 8, 12, 16, 18, 20, 22 and 24.

Figure 3:
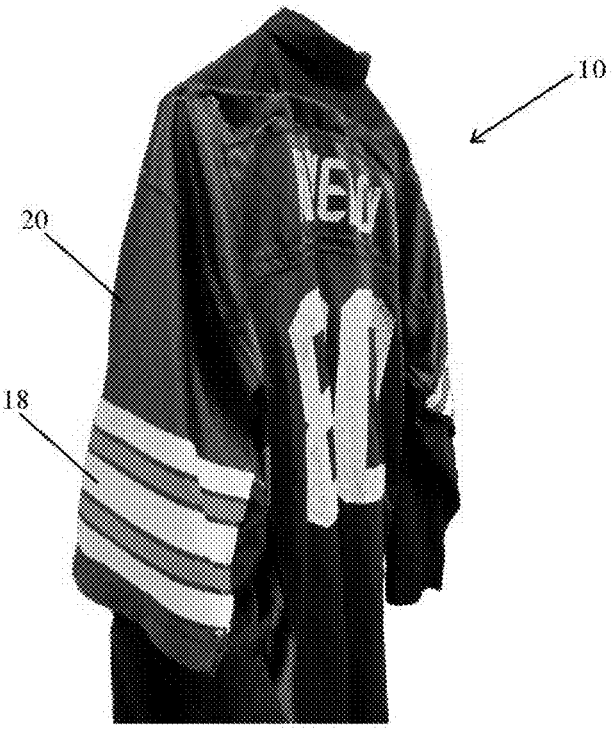
FIG. 3 is a side rear view of the jersey shirt.
Figure 4:
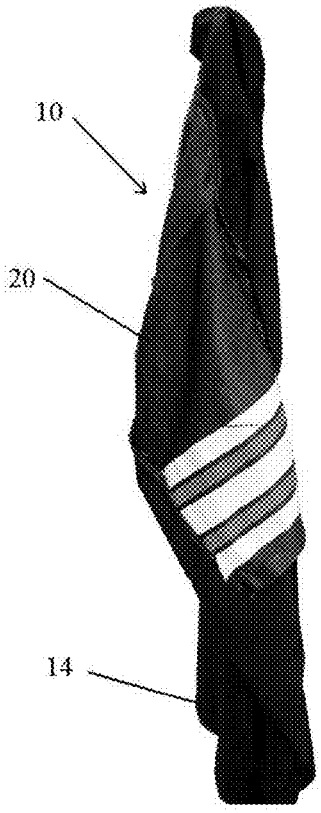
FIG. 4 is a view of the opposite side of the jersey shirt.
Figure 5:
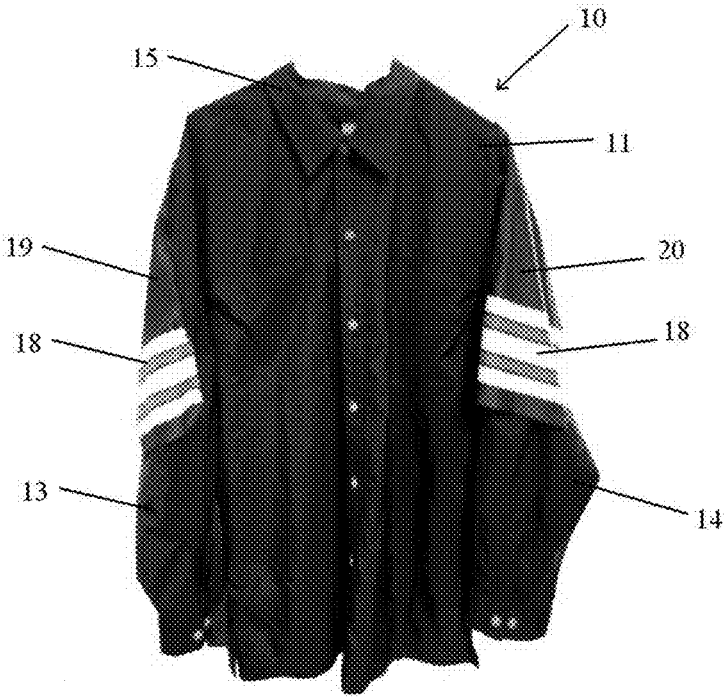
FIG. 5 is a frontal view and showing the rear of the sleeves of the jersey shirt.

As shown in FIGS. 3-5, jersey sleeve portions 19 and 20 extend partway down the dress shirt sleeves 13 and 14, respectively. The configuration of the back jersey portion may depend on the sport represented by the jersey portion, for example, a basketball jersey back portion may not have a sleeve portion, a soccer jersey back portion may have sleeve portions that extend to the wrist of a wearer, and football, baseball, rugby and hockey jersey back portions may have sleeve portions that extend partway down a wearer's arm, as shown in the football jersey of the drawings.

The jersey shirt 10 of the invention may be unitary and reversible, for example, to accommodate a team's home and away jerseys or showing two different sports teams. A reversible jersey shirt may have buttons on both sides of the shirt opening and cuff portions to permit the shirt to be worn showing both jersey back portions. The formal portion of the jersey shirt may be made of any color, or first color, and constructed of any fabric known in the art. The collar portion of the formal shirt portion may have any configuration known in the art, for example, a turned down collar, a band collar, etc. The jersey shirt of the invention may be comprised of a unitary formal shirt with a jersey back portion sewn onto the dress shirt so that the back of the shirt has two layers of fabric, or may be comprised of a unitary formal shirt front and sleeve portion sewn to a jersey back and sleeve portion so that the entire shirt is one layer of fabric, for example.

Figure 6:
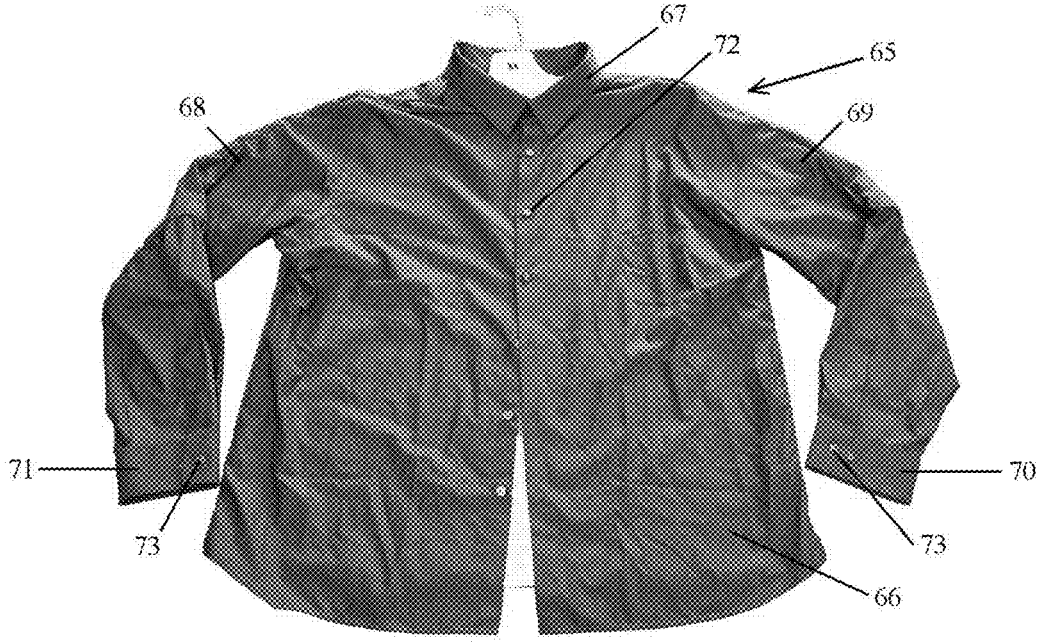
FIG. 6 is a frontal view of the jersey shirt of the invention and showing the frontal formal shirt appearance.
Figure 7:
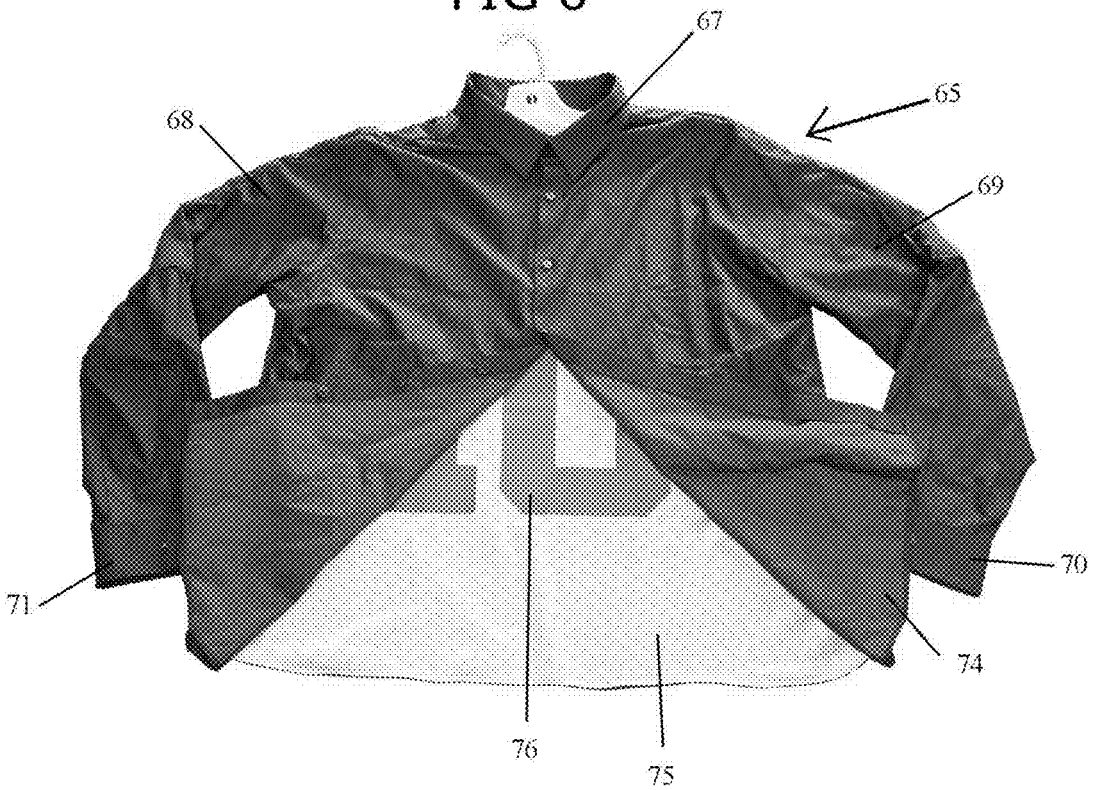
FIG. 7 is another frontal view of the jersey shirt of FIG. 6.

Referring to FIGS. 6-15, a reversible jersey shirt 65 is shown having a formal front shirt body 66, collar 67 and long sleeves 68 and 69, each terminating with cuffs 71 and 70, respectively. The formal front has buttons 72 and the cuffs each have buttons 73. As shown in FIG. 7, the inside back of the shirt 65 has a back body 75 with numeral 76 and lettering 91 which becomes the outside back of the jersey shirt 65 when reversed and as showing in FIG. 12.

Figure 8:
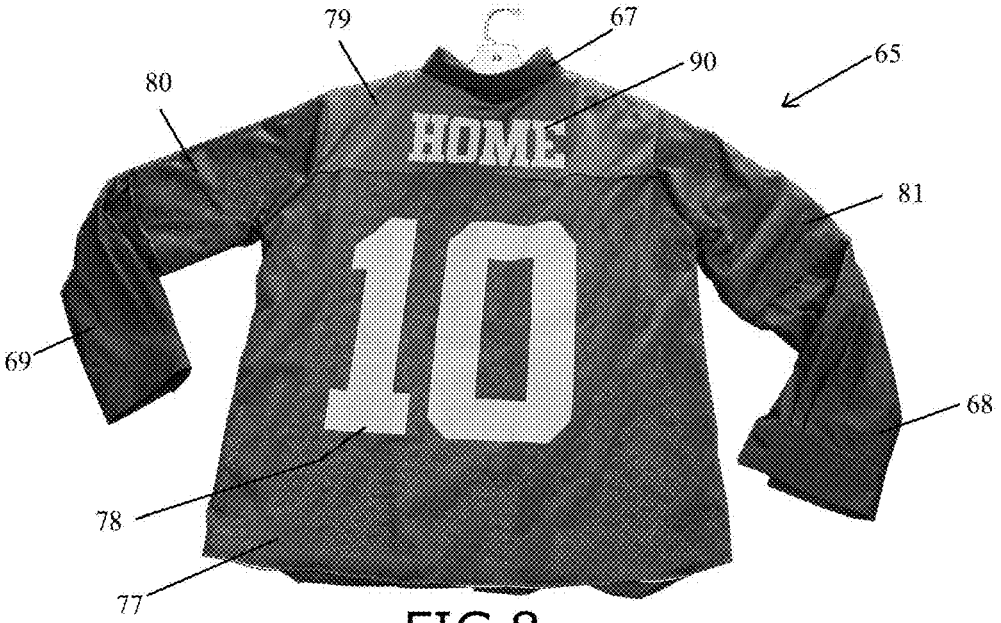
FIG. 8 is a rear view of the jersey shirt of FIG. 6 and showing the sports jersey appearance.
Figure 9:
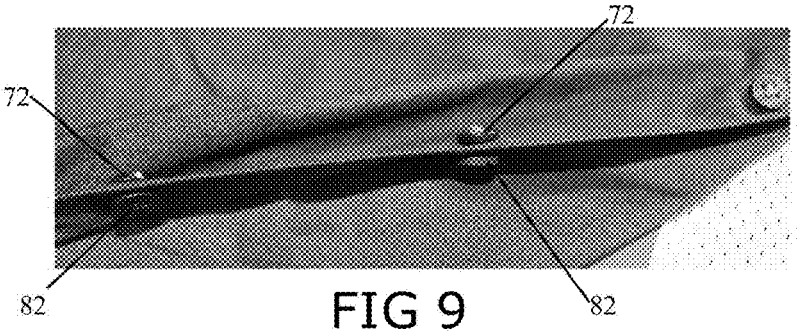
FIG. 9 is a closeup view of the front button up portion of the jersey shirt of FIG. 6.
Figure 10:
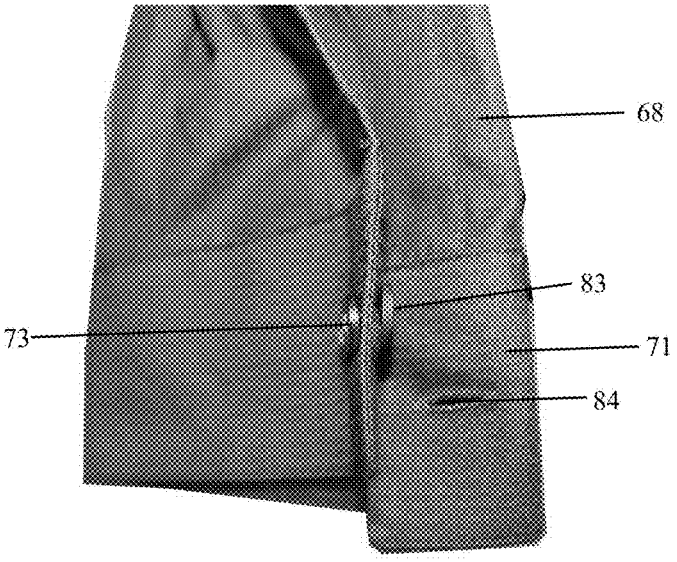
FIG. 10 is a closeup view of a cuff of the jersey shirt of FIG. 6.
Figure 12:
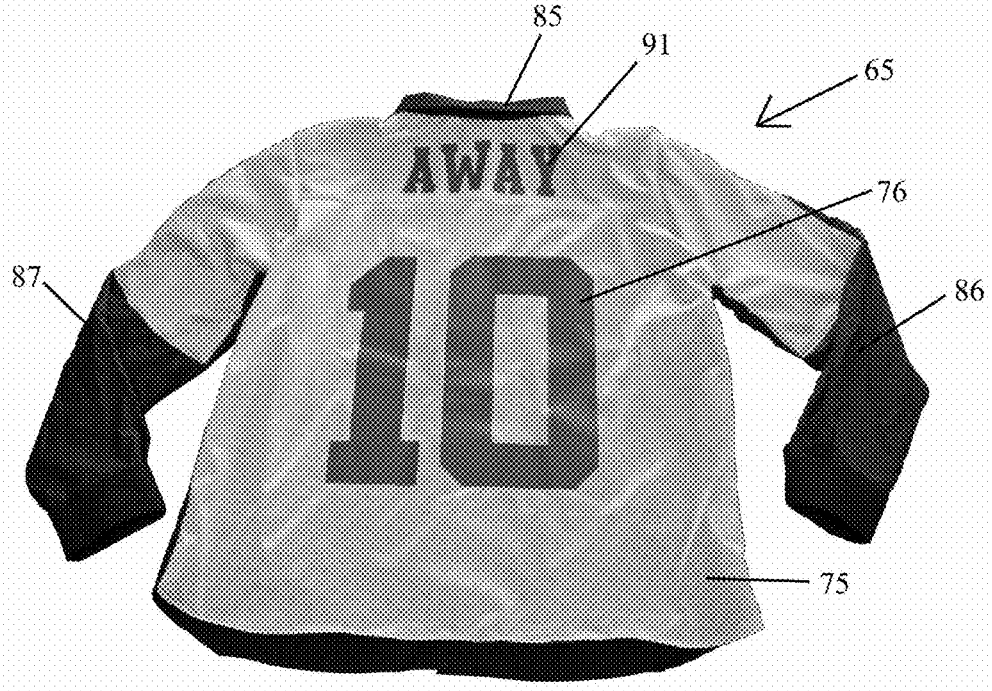
FIG. 12 is a rear view of the reversed jersey shirt of FIG. 6.

FIG. 8 shows the back shirt body 77 of the jersey shirt 65. The formal collar 67 is shown and as viewed from the back, upper portion 79, sleeve top portions 80 and 81 shown extending down to the back of the elbow and numeral 78 are seen by a viewer when the jersey shirt 65 is worn. The back shirt body 77 is designated as the HOME jersey, shown as lettering 90, as opposed to the AWAY jersey, shown as lettering 91, when the jersey shirt 65 is reversed as shown in FIG. 12. FIG. 9 shows the aligned buttons 72 and 82 which allow the formal shirt portions (reversed) to be buttoned through the same button hole. Likewise, in FIG. 10 aligned buttons 73 and 83 permit both cuffs (reversed) to utilize the same button hole 84. Thus, the front and cuffs both utilize common button holes with aligned buttons on either side of the garment.

Figure 11:
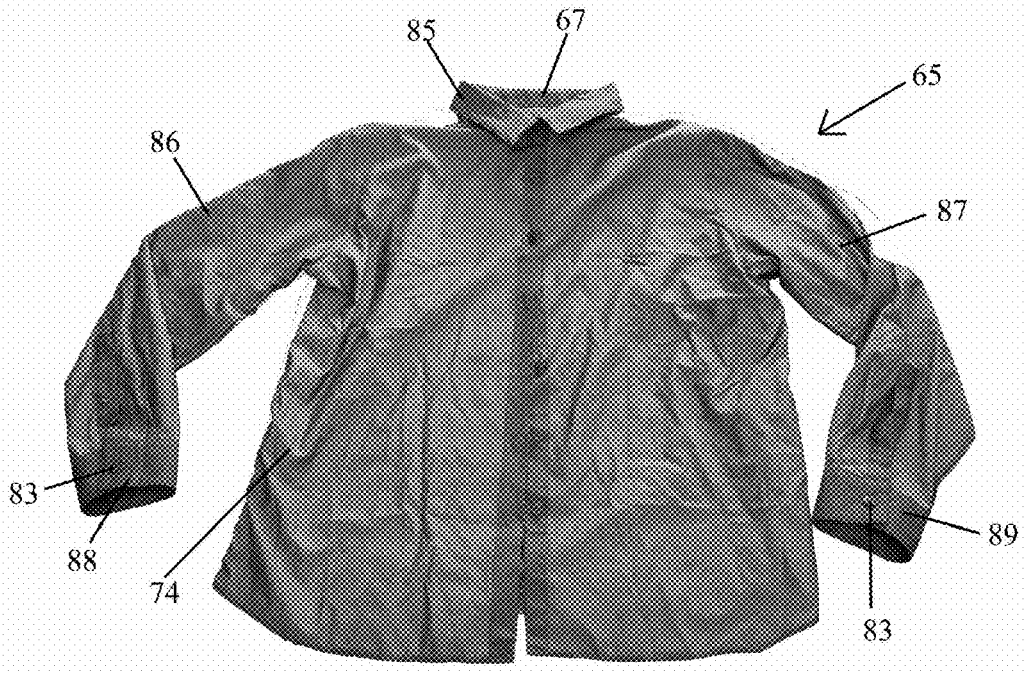
FIG. 11 is a frontal view showing the reversed frontal formal shirt appearance of the jersey shirt of FIG. 6.
Figure 13:
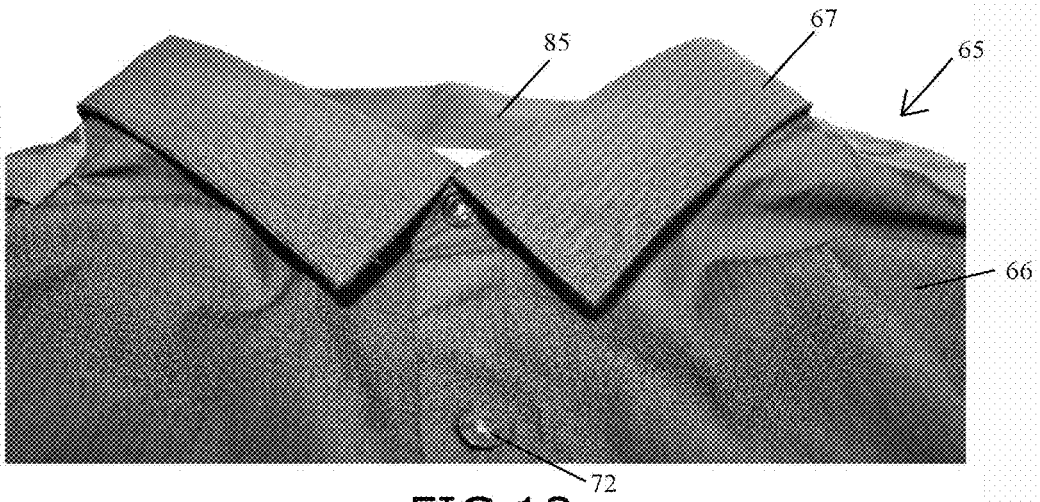
FIGS. 13-15 are closeup views of the formal collar of the jersey shirt of FIG. 6.
Figure 14:
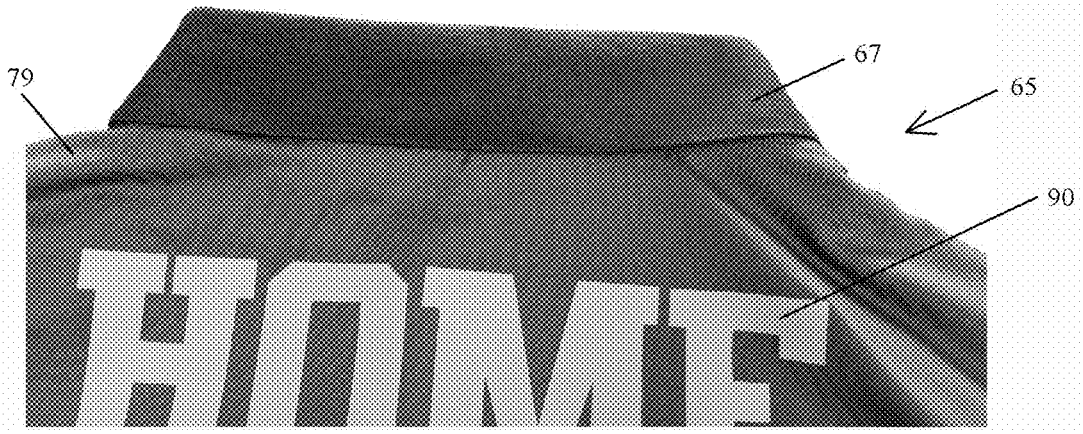
Figure 15:
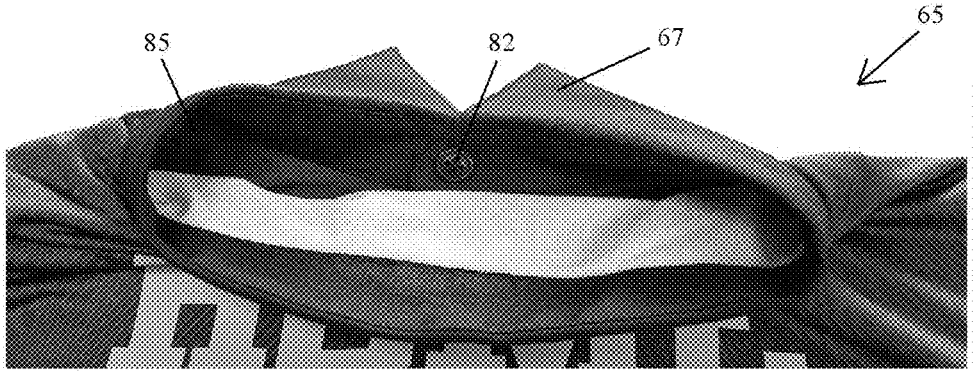

FIGS. 11 and 12 show the reversed jersey shirt 15 whereby the formal front is similar to that shown in FIG. 6 and whereby the back shirt body 75 shows a similar jersey shirt except having the AWAY coloration of a sports team, as is common in the various sports, i.e., home and away jerseys. As further shown, the front onion 74 is the back portion of front portion 66 when the jersey shirt 65 is reversed. The reversed front sleeve portions are shown as 86 and 87, each having cuffs 88 and 89, respectively. FIGS. 13-15 are close-up views showing the formal collar 67, 85 of the jersey shirt as well as the buttons 72, 82 and which permit the jersey shirt 65 to provide three different views namely, a formal front and home and away jersey shirt back portions. Thus, a wearer is able to wear the jersey shirt 65 with a suit or sports jacket and either a home or an away back shirt jersey depending upon the place and location of the sporting event.

Figure 16:
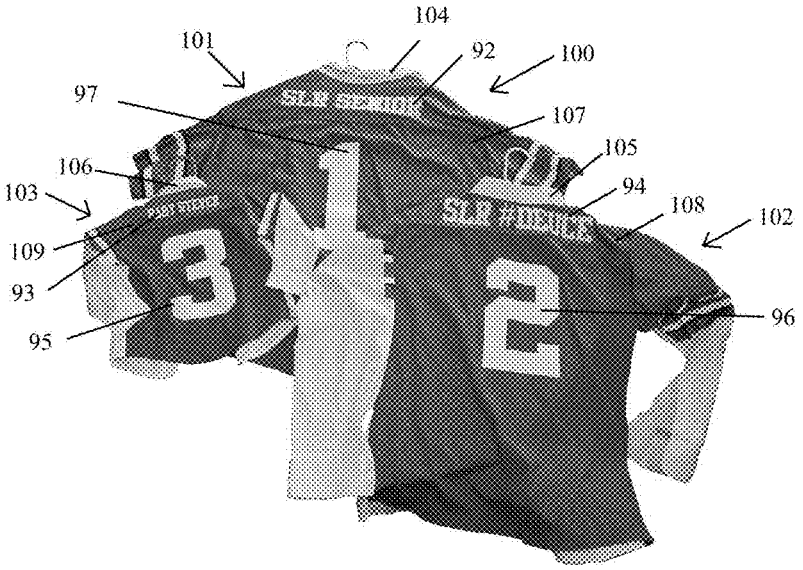
FIG. 16 shows rear views of a set of jersey shirts according to the present invention.

FIG. 16 shows a jersey shirt set 100 comprised of a large jersey shirt 101, a medium jersey shirt 102 and a small jersey shirt 103. The sports jersey set 100 provides the formal frontal portion appearances as well as the back sports jersey appearances in different sizes so that a family, i.e., father and sons, may be similarly attired in both a formal setting and for a sporting event gathering by merely removing a jacket, for example. As shown, each jersey shirt 101, 102 and 103 has a formal collar 104, 105 and 106, respectively, and a sports jersey back portion 107, 108 and 109, respectively. The respective sports jersey back portions each have matching multiple colorings, lettering 92, 94 and 93, respectively, and numerals 97, 96 and 95, respectively.

Figure 17:
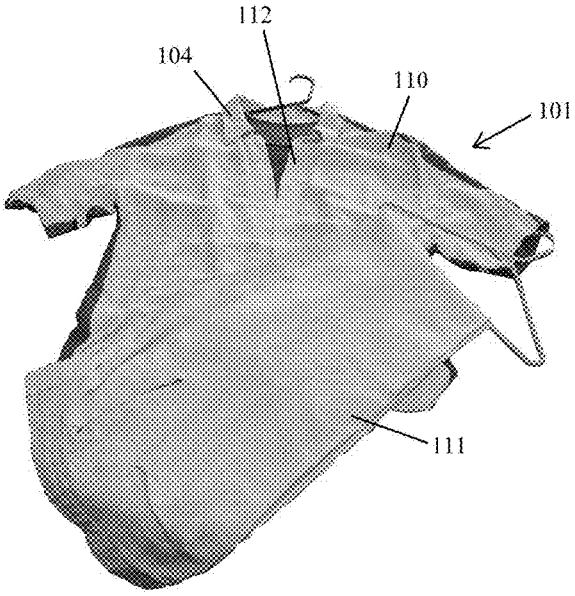
FIGS. 17 and 18 are front and rear views, respectively, of the jersey shirt and further showing the jersey shirt with accompanying trousers.
Figure 18:
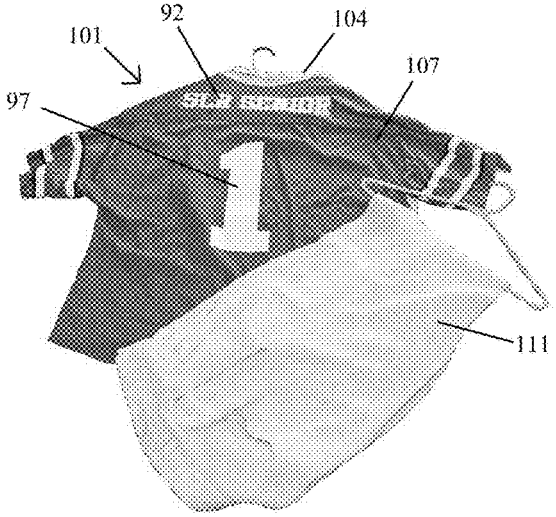

Referring particularly to FIGS. 17 and 18, the large size jersey shirt 101 is shown to have formal collar 104 visible on both the front and back of the garment, a formal front 110 having a button down front portion, and further showing the back portion 107 having the multi-color appearance with lettering 92 and numeral 97. Additionally, a pair of slacks 111 is shown and having a coloring to match the frontal 110 appearance of the jersey shirt 101. The smaller jersey shirt sizes 102 and 103 may also be provided with appropriately sized slacks matching the coloration and structure of slacks 111.

Figure 19:
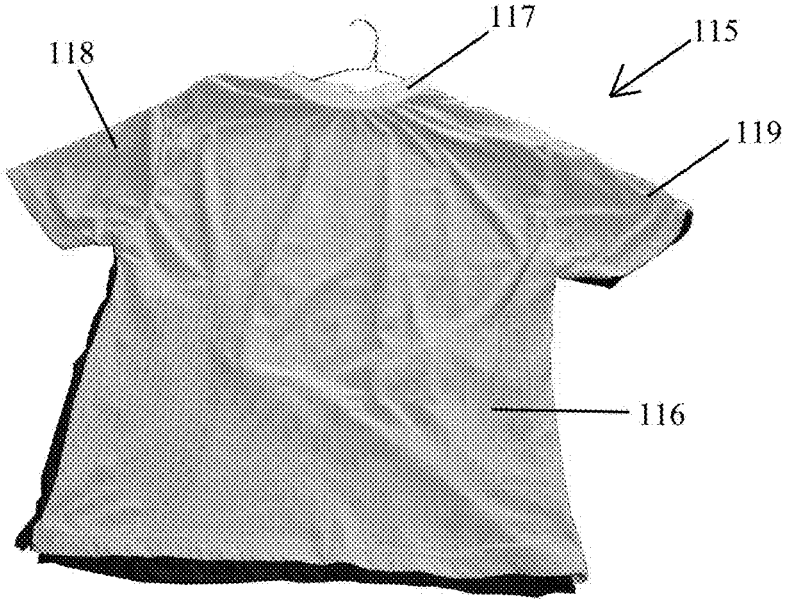
FIGS. 19 and 20 are front and rear views, respectively, of a jersey shirt of the invention.
Figure 20:
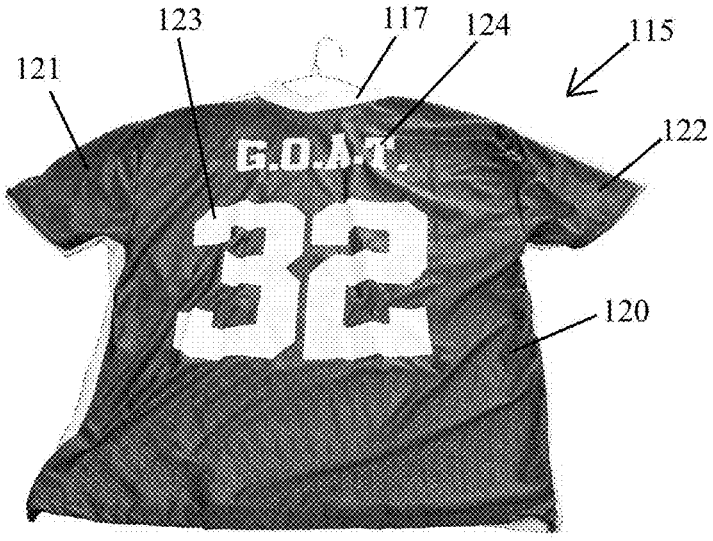

FIGS. 19 and 20 show jersey shirt embodiment 115 having a solid or first color frontal appearance 116, a collar 117, and sleeves 118 and 119. When viewed from the rear, only collar 117 having the solid or first color is unchanged. The back 120 of the jersey shirt 115 shows a multicolored or second color sports jersey appearance having numerals 123, lettering 124 and sleeve portions 121 and 122.

Figure 21:
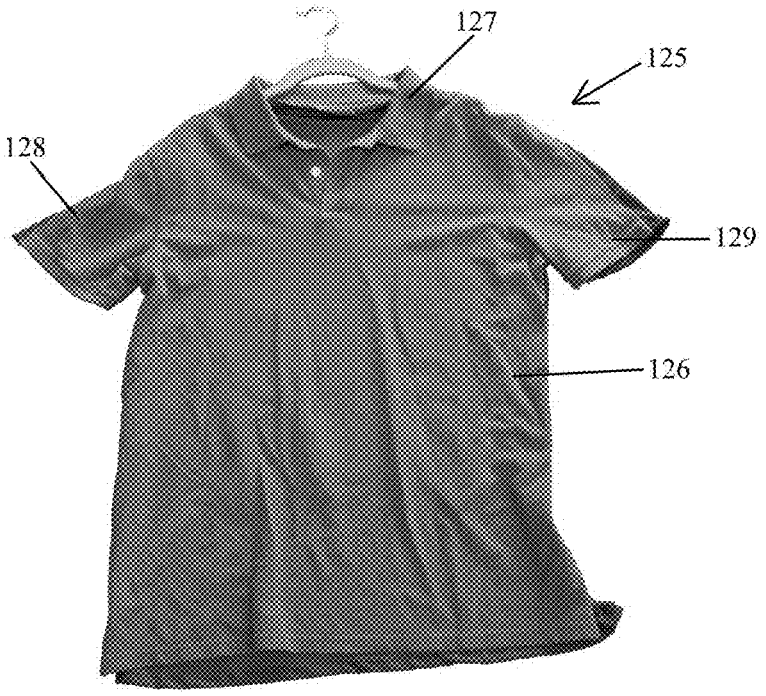
FIGS. 21 and 22 are front and rear views, respectively, of a jersey shirt of the invention.
Figure 22:
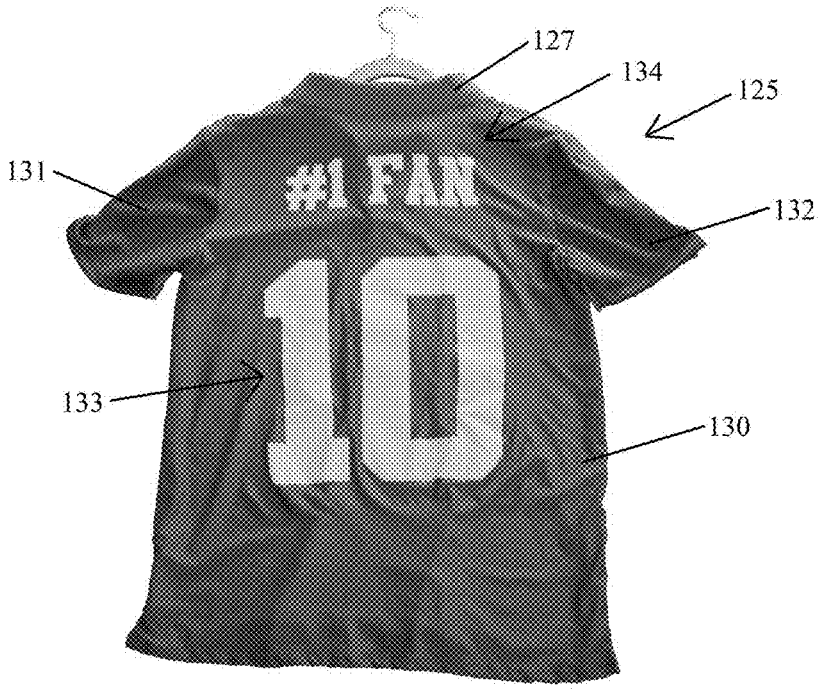

FIGS. 21 and 22 show jersey shirt embodiment 125 having a polo shirt appearance with a frontal shirt body 126 having collar 127 and sleeves 128 and 129. The collar 127 is likewise visible from the rear of the garment where the sports jersey appearance 130 includes multiple coloration, numerals 133, lettering 134 and rear sleeve portions 131 and 132.

Figure 23:
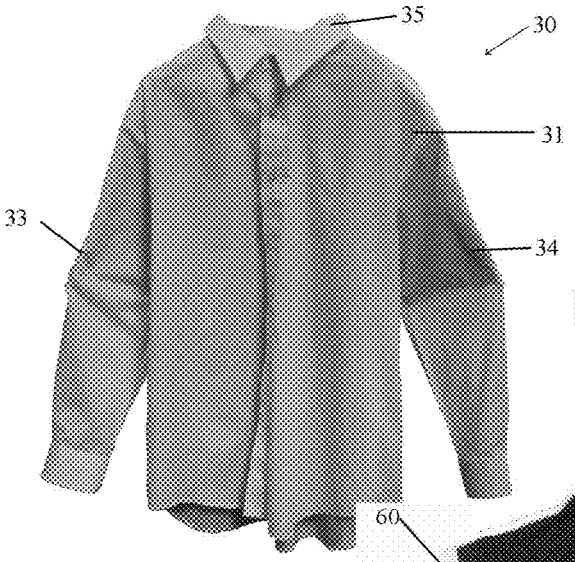
FIG. 23 is a frontal view of the jersey shirt of the present invention and showing the formal shirt appearance.
Figure 24:
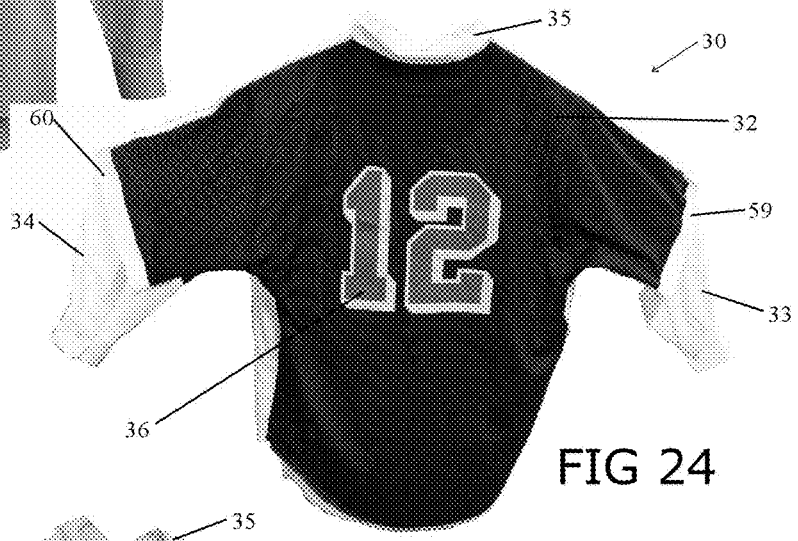
FIG. 24 is a rear view of the jersey shirt of FIG. 23 and showing the sports jersey appearance of the shirt.
Figure 25:
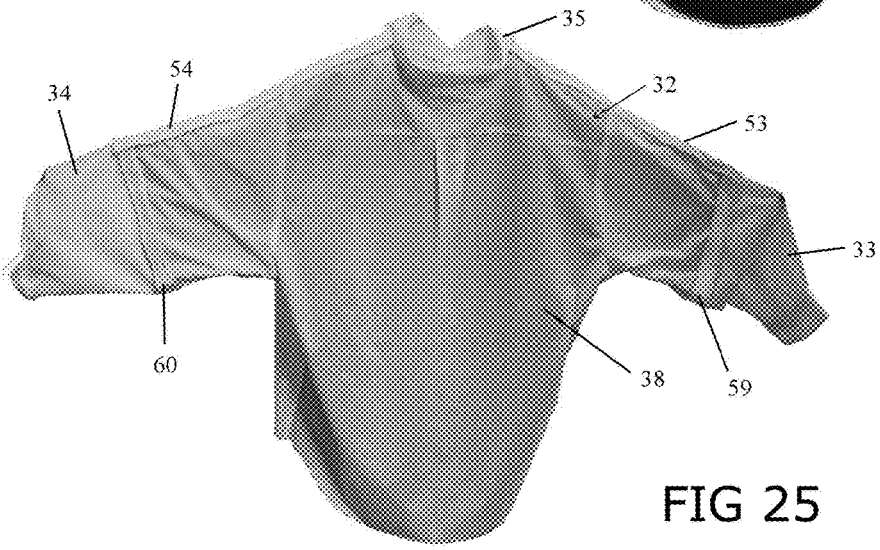
FIG. 25 is a rear view of the jersey shirt of FIG. 23 and showing the formal appearance of the shirt.

As shown above, the various components of the jersey shirts are sewn together. However, the jersey shirt may be comprised of separable components, as shown in FIGS. 23-25. For example, the jersey shirt may have a formal appearance front portion with a collar and sleeve components and having fastening means to receive sports jersey components comprising a jersey shirt back with sleeve back components. The latter separable garment provides a formal appearance when viewed from the front of the wearer and a sport or like appearance when viewed from the back of the wearer.

Referring to FIGS. 23-25, jersey shirt 30 is shown having collar 35, sleeves 33 and 34, front formal shirt appearance or shirt frame 31 and separable rear shirt portion 32. Sports number 36 is shown on the rear shirt portion 32. Removable rear shirt portion 32 is reversible and has two sides, the first side being sports jersey appearance 37 and the second, opposite side being formal shirt appearance 38. It is within the purview of the invention for the two sides of the removable rear shirt portion 32 to have different and related configurations, for example, two different sports jersey appearances, home and away jersey appearances, etc.

Each side of rear shirt portion 32 has peripheral fastening means that cooperate with fastening means on formal shirt frame 31. Fastening means may be located along the sleeve top of jersey side 37, fastening means may be located along the sleeve ends of jersey side 37 and fastening means may be located along the sleeve bottom and torso of jersey side 37. Further, fastening means may be located along the sleeve top of formal side 38, fastening means may be positioned along the sleeve ends of formal side 38 and fastening means may be located along the sleeve bottom and torso of formal side 38. Collar fastening means may be located along the collar of sides 37 and 38. Additionally, fastening weans may be located between the sides 37 and 38 of the removable rear shirt portion, for example along the bottom hem of the rear shirt portion. The fastening means of the reversible shirt back portion are hook and loop fasteners attached to the periphery on each side of the reversible shirt back portion, including strips along the tops and ends of the sleeves, along the bottom of the sleeve and torso and circular fastening members along the collar. The fastening members may be of any configuration, i.e. elongated strips or individual and aligned members and may be sewn, glued or otherwise adhered or fixed to the reversible shirt back portion. Top sleeve fastening means 53, 54 have a flap configuration having fabric on one side and a strip of hook and loop fastening material on the other, so that the assembled shirt has the look of having seams that match the formal side. The fastening means of the formal shirt frame may be hook and loop fasteners attached to the periphery of the opening in the back of the shirt frame, including strips along part of the tops and at the midpoints of the sleeves, along part of the bottom of the sleeve and along the torso and circular fastener members along the collar. The fastening members may be of any configuration, i.e. elongated strips or individual and aligned members and may be sewn, glued or otherwise adhered or fixed to the formal shirt frame.

Sleeve strips 59, 60 have two sides, one having fastening means disposed thereon and the other having fabric to match the fabric of the formal shirt frame. Cooperating sleeve strips 59, 60 are shown covering the outwardly exposed fastening means that are on the shirt portion facing out and thus not directly attached to shirt frame 31, providing a pleasing appearance to the rear of the shirt 30. The peripheral fastening means and cooperating sleeve strips fasten the removable back portion to the front formal shirt frame so that the fastening means have the appearance of traditional shirt seams.

As shown in the drawings, fastening means such as cooperating hook and loop fasteners or the like are provided about the periphery of the shirt front portion and beneath the collar so as to receive the shirt back portion. Any fastening means known in the art may be utilized, for example, pressure sensitive adhesive, mechanical fastening means, or the like. As further shown in the drawings, the shirt back portion may be reversible and extend down the back of the sleeves of the sports jersey. It is within the purview of the invention to provide a jersey shirt for both male and female wearers, i.e., a shirt for a female may have a different style collar, button placket, etc.

As many changes are possible to the jersey shirt of this invention utilizing the teachings thereof, the descriptions above and the accompanying drawings should be interpreted in the illustrative and not in the limited sense.

That which is claimed is:

1. A unitary and reversible jersey shirt constructed to be worn under a jacket having a front portion, a back portion, a collar and long sleeves with cuffs, each long sleeve having a front sleeve portion and a back sleeve portion with an elbow portion, said jersey shirt comprising a button down front portion, a collar constructed and arranged for receiving a tie and said front portion, said collar, said front sleeve portion and cuffs each having the same first color, said back portion of said unitary and reversible jersey shirt having a number and letter and a second color to thereby provide a first sports jersey appearance on said back portion and said back sleeve portion and extending down to said elbow portion, said front portion further having a first set of buttons and button holes and having a second set of buttons on the opposite side of said first set of buttons, whereby said jersey shirt when worn with a jacket provides a formal dress attire having said first color when viewed from the front and back of the wearer and whereby a sports jersey appearance is provided by said jersey shirt when the jacket is removed, said back portion of said jersey shirt further having an interior surface and wherein a second sports jersey appearance having a number, a letter and a third color is provided on said interior surface and wherein said jersey shirt is constructed and arranged to be reversible to thereby expose said second sports jersey appearance as said second set of buttons is utilized.

2. The jersey shirt of claim 1, wherein said first and second sports jersey appearances include multiple colors and are selected from the group of jerseys consisting of professional, college, and high school, football, basketball, baseball, soccer, hockey, rugby, track, tennis teams and clubs.

3. The jersey shirt of claim 1, wherein said back portion of said unitary and reversible jersey shirt comprises two back panels of fabric, each said back panel having a sport jersey appearance.

4. The jersey shirt of claim 1, wherein said second sports jersey has different colors, the same numeral and letters as said first sports jersey to thereby provide an appearance related to said first sports jersey appearance.

5. The jersey shirt of claim 1, wherein said jersey shirt is provided in a set of jersey shirts including a large, medium and a small size.

6. The jersey shirt of claim 1, wherein said front and back portions are sewn together and wherein a pair of coordinating slacks is provided.

7. A jersey shirt having a front portion, a back portion, a collar, a pair of long sleeves, each said long sleeve having an elbow portion, said jersey shirt comprising said front portion having a cuff on each long sleeve, a collar structure adapted to receive a tie and a first color to thereby provide a formal shirt appearance, said back portion of said jersey shirt having a second color and displaying a numeral and a letter to thereby provide a sports jersey appearance below said collar, said sleeves having a back portion having said second color to provide a sports jersey appearance down to said elbow portion, whereby the wearer of said jersey shirt when wearing a jacket appears dressed in a formal shirt when viewed from the front and back and when viewed without a jacket from the front appears dressed in a formal shirt and when viewed from the back without a jacket appears dressed in a sports jersey.

8. The jersey shirt of claim 7, wherein said first color of said front portion is a solid color and is contrasting with said second color of said back portion contrasting colors.

9. The jersey shirt of claim 7, wherein said back portion of said jersey shirt has an interior surface having a third color, number and a letter to provide a second sports jersey appearance and wherein said jersey shirt is reversible.

10. The jersey shirt of claim 7, wherein said front portion and said back portion, collar and sleeves are stitched together as a unitary shirt.

11. The jersey shirt of claim 9, wherein said sports jersey appearance is selected from the group of jerseys consisting of professional, college, and high school, football, basketball, baseball, soccer, hockey, rugby, track, tennis teams and clubs.

12. The jersey shirt of claim 11, wherein said first and second sports jersey appearances have related colors and have the same said numeral.

13. The jersey shirt of claim 11, wherein said jersey shirt is provided in a set of jersey shirts including a large, medium and a small size.

14. A jersey shirt formed of a first fabric member and a second fabric member, said first fabric member having a shirt front portion a collar and long sleeves with cuffs, each sleeve having a sleeve front portion and a sleeve back portion with an elbow portion, said jersey shirt comprising a first color on said shirt front portion, on said collar and on each said sleeve front portion and cuffs, said jersey shirt on said second fabric member having a shirt back portion with a second color, a numeral and letter and having said second color on each said sleeve back portion and down to said elbow portion, said shirt front portion and said shirt back portion each having a periphery, whereby the wearer of said jersey shirt when wearing a jacket appears dressed in a first color shirt when viewed from the front and back by means of said collar and long sleeves with cuffs and whereby the wearer of said jersey shirt when the jacket is removed and viewed from the front appears dressed in a first color shirt and when viewed from the back appears dressed in a second color shirt with a numeral and letter.

15. The jersey shirt of claim 14, wherein said second fabric member is selected from the group of jerseys consisting of professional, college, and. high school, football, basketball, baseball, soccer, hockey, rugby, track, auto and bicycle racing teams, tennis teams and clubs.

16. The jersey shirt of claim 14, wherein said second fabric member is reversible and having first and second surfaces each of said first and second surfaces having different colors and the same numeral and letter.

17. The jersey shirt of claim 16, wherein said second surface of said second fabric member has an appearance related to the appearance of said first surface with respect to type of sport or sport's team.

18. The jersey shirt of claim 14, wherein said jersey shirt is provided in a set of jersey shirts including a large, medium and a small size.

19. The jersey shirt of claim 9, wherein said front portion of said jersey shirt has a button down front with aligned first and second buttons on either side.

20. The jersey shirt of claim 16, wherein said first fabric member of said jersey shirt has a button down front with aligned first and second buttons on either side.

* * * * *